US005591023A

United States Patent [19]

Nakamura et al.

[11] Patent Number: 5,591,023

[45] Date of Patent: Jan. 7, 1997

[54] ROTARY TYPE COMPRESSOR

[75] Inventors: Hideki Nakamura, Yonago; Keiji Yamasaki; Fujio Yamane, both of Yasugi; Toshiki Yoshida, Tochigi-ken; Tadashi Iizuka, Ashikaga; Akihiko Ishiyama, Tochigi-ken, all of Japan

[73] Assignees: Hitachi Metals, Ltd.; Hitachi, Ltd., both of Tokyo, Japan

[21] Appl. No.: 541,966

[22] Filed: Oct. 10, 1995

[51] Int. Cl.[6] ..... F01C 21/00

[52] U.S. Cl. ..... 418/179

[58] Field of Search ..... 418/179

[56] References Cited

U.S. PATENT DOCUMENTS 5,423,664 6/1995 Lizuka et al. ..... 418/179

FOREIGN PATENT DOCUMENTS 55-107094 8/1980 Japan .
55-31179 8/1980 Japan .
55-48584 12/1980 Japan .
60-1943 1/1985 Japan .
63-159692 7/1988 Japan .
1-18985 4/1989 Japan .
5-9660 1/1993 Japan .
5-171376 7/1993 Japan .
5-279809 10/1993 Japan .

*Primary Examiner*—Charles G. Freay
*Attorney, Agent, or Firm*—Sughrue, Mion, Zinn, Macpeak & Seas

[57] ABSTRACT

A compressor comprising a roller made of a cast iron which has a hardness of HRC 50 or more after heat treatment, and contains not less than 5 area % of graphite, and not less than 2 area % of crystallized eutectic structure including iron phosphide, and either a vane made of a material which has a hardness of HRC 70 or more after heat treatment and contains not less than 25 area % of undissolved carbides and nitride particles in total, the undissolved carbides including not less than 10 area % of MC type carbides, the nitride particles including at least one of TiN and NbN of not less than 5 area %, the undissolved carbides and the nitride particles having a mean grain size of not more than 5 μm, or a vane made of a material including at least one of TiN and NbN particles of not less than 5 area %, the TiN and NbN particles having a mean grain size of not more than 5 μm, the material essentially consisting of, by weight, 2.0 to 4.0 % of C, not more than 2.0 % of Si, not more than 1.5 % of Mn, 2.5 to 8.0 % of Cr, 20 to 40 % of W+2Mo, 3.0 to 15 % of V, not more than 15 % of Co, and the balance of Fe, the material having a hardness of HRC 65 or more after heat treatment.

4 Claims, 2 Drawing Sheets

ROTARY TYPE COMPRESSOR

BACKGROUND OF THE INVENTION

The present invention relates to a rotary type compressor having a cylinder, an eccentric roller and a vane, which is applied to a refrigeration cycle in an air conditioner, a refrigerator or the like and, more particularly, to a compressor in which hydrofluorocarbon (hereinafter referred to as HFC) can be suitably used as a refrigerant in place of chlorofluorocarbon (hereinafter referred to as CFC).

As shown in a cross-sectional view of FIG. 2, a rotary type compressor usually comprises a cylinder 3, a roller 2 which eccentrically rotates in contact with the inner surface of the cylinder 3, and a vane 1 which has rectangular shape and extends along a guide groove of the cylinder 3 and is pushed by biasing means, e.g., a spring 4, so that the distal end of the vane 1 is pressed against the roller 2. Generally, the biasing means is introduced by a gaseous pressure or a hydraulic pressure, or resilient means such as a spring (the spring 4 in FIG. 2). Therefore, the distal end of the vane 1 is pressed against the outer peripheral surface of the roller 2, and the roller 2 rotates eccentrically while it is constantly pressed by the vane 1 in this manner.

In accordance with an increase of a gas compression ratio, a rotational speed of the roller is increased, and consequently, the sliding-contact surfaces of the vane and the roller tend to be worn by a remarkable degree. The roller is in sliding contact with the vane and the cylinder at its outer peripheral surface during rotation as described above. Thus, the roller is required to have properties making it resistive to wear and preventing it from imparting damage to the vane and the cylinder of the mating members.

CFC is used as a refrigerant for compressors. As well known, when CFC goes up to the stratophere, it is decomposed by irradiation of ultraviolet rays, thereby discharging chlorine which destroys the ozone layer. Such destruction of the ozone layer is globally considered as an environmental problem. Projects for totally abolishing use of CFC by the year 2000 have been formed, and development of an alternative refrigerant has progressed.

As an alternative refrigerant, HFC containing no chlorine, is the most promising. For example, 1,1,1,2 tetrafluoroethane ($CH_2FCF_3$) known as R-134a may be raised. Use of such kind of fluorocarbon involves the following problems with respect to compressors when it is compared with use of the conventional CFC even though HFC does not as adversely affect the environment.

1. A lubricative property of the refrigerant is inferior.
2. The compression ratio must be increased, and consequently, the load acting on the roller and the vane becomes greater.
3. A hygroscopic property of the refrigerant is larger.
4. A lubricative property of a lubricant is inferior.
5. A hygroscopic property of the lubricant is larger.

Under the above-described circumstances, the following problems are caused in relation to sliding contact members such as the cylinder, the roller and the vane.

1. Wear of the sliding contact members increases. (Wear of the roller and the vane particularly increases.)
2. The tendency of seizure of the roller and the vane is higher.

More specifically, since the conventional CFC contains chlorine, it forms a stable protective film (chloride) on the surfaces of the sliding contact members so as to provide the sliding contact surfaces with good wear resistance and anti-seizure properties. On the other hand, HFC of an alternative fluorocarbon, contains no chlorine. Therefore, unlike with use of CFC, an advantageous effect of improving the wear resistance and anti-seizure properties cannot be expected, and HFC involves a different problem in practical use.

In order to solve the problem, it is effective for a material of the vane to has increased hardness and to increase an additive amount of hard carbides. As this type of material, for example, JP-A-5-9660, JP-A-5-171376, JP-A-5-279809 have been known. With such a material, the wear resistance and anti-seizure properties of the vane can be improved to some extent.

Conventionally, the roller has been made of cast iron by continuous casting, eutectic graphite cast iron, or Cu—Cr-system, Cu—Mo-system or Mo—Ni—Cr-system low alloy cast iron. Because the roller involves more restrictions regarding the cost than the vane, the above-mentioned cast irons are most suitable. In such a case, it is effective to increase hardness and strength of the matrix and to make graphite finer. This type of material is disclosed in, for example, JP-B2-60-1943.

According to the foregoing method of improving the vane, the material contains large amounts of expensive alloying elements resulting increased the cost. Further, according to such way, although an amount of wear of the vane itself is decreased, an attacking influence on the roller is increased. Consequently, wear of the roller is increased, thus easily deteriorating the anti-seizure property of the roller.

Also, according to the above-described method of improving the roller, improper increases in hardness and strength of the matrix thereof cause an attacking influence on the vane to increase wear of the vane resulting in deteriorating the anti-seizure property of the vane.

In other words, anti-seizure and wear resistance properties cannot be fully improved by solely improving either one of the vane and the roller. It is important to improve these properties by a conformable optimum combination of a vane and a roller.

SUMMARY OF THE INVENTION

It is therefore an objective of the present invention to provide an improved rotary type compressor comprising a roller and a vane which are made of the optimum combination of materials in order to prevent seizure of the roller and the vane and to decrease amounts of wear of these two members when HFC is used as a refrigerant, so that the compressor can accordingly endure long-term continuous operation.

According to a first feature of the invention, there is provided a rotary type compressor comprising a cylinder, a roller and a vane as main structural components, wherein the roller is made of a cast iron which has a hardness HRC 50 or more after quenching tempering heat treatment, the cast iron containing not less than 5 area % (microstructure) of graphite, and not less than 2 area % of crystallized eutectic structure including iron phosphide, and the vane is made of an iron alloy which has a hardness HRC 70 or more after quenching and tempering heat treatment, the iron alloy containing not less than 25 area % of undissolved carbides and nitride particles in total, the undissolved carbides including not less than 10 area % of MC type carbides, the nitride particles including at least one of TiN and NbN of not less than 5 area %, the undissolved carbides and the nitride particles having a mean grain size of not more than 5 μm.

According to a second feature of the invention, there is provided a rotary type compressor of substantially the same structure as that of the first feature, comprising substantially the same roller as that of the first feature, and a vane made of an iron alloy including at least one of TiN and NbN particles of not less than 5 area %, either of the TiN and NbN particles having a mean grain size of not more than 5 μm, the iron alloy essentially consisting of, by weight, 2.0 to 4.0% of C, not more than 2.0% of Si, not more than 1.5% of Mn, 2.5 to 8.0% of Cr, at least one of not more than 30% of W and not more than 20% of Mo in a range of 20 to 40% in terms of "W+2Mo", 3.0 to 15% of V, not more than 15% of Co, and the balance of Fe and unavoidable impurities, the iron alloy having a hardness HRC 70 or more after quenching and tempering heat treatment.

In either of the rotary type compressors according to the first and second features of the invention, preferably, the vane is subjected to a surface treatment for improving the sliding-contact property, such as nitriding, oxynitriding, sulphonitriding and homo-treatment, if necessary.

The invention relates to a combination of a vane and a roller. The optimum combinations of a vane and a roller are disclosed in (1) JP-B2-55-31179 and (2) JP-B2-55-48584 as "relative sliding members", and disclosed in (3) JP-A-55-107094 and (4) JP-B2-1-18985 as a rotary pump and a rotary-type fluid compressor, respectively. In the first two publications, a vane of high-carbon and high-copper iron-system sintered material containing Mo is combined with a roller of alloy cast iron having a particular composition. In the publication (4), a vane of high-carbon and high-chromium alloy steel subjected to nitriding treatment is combined with a roller of a material in which two kinds of substances, such as fine flake graphite and carbide, are dispersed in the tempered martensite matrix hardened to HRC 40 to 45. In the publication (3), a chromium-plated vane is combined with a rotor housing and a roller which are made of specific materials.

The present inventors conducted friction tests of rollers according to the invention with vanes of various materials and found that adhesions derived from a roller material were provided on the sliding-contact surface of a vane of each specimen which caused seizure, and that the roller material exhibited intense plastic fluidizing in the sliding-contact surface layer. From these results, it was judged that seizure and wear of these rollers and vanes occurred because the roller and vane materials were adhered to each other through friction and the roller material was partially removed forcedly from under the adhered portion. The situations seem to be substantially the same in the case of friction under a pressure not higher than a contact pressure at which seizure occurs. (In a rotary type compressor used at present, an absolute value of a wear amount of the roller material is generally several times larger than that of the vane.)

In such kind a rotary type compressor, no problem arises in operation of a vane even if the height size of the vane is slightly reduced by wear. However, wear of a roller, which will increase leak between the roller and a cylinder, must be restrained to the minimum. Especially, wear to such a degree that the roller will be partially removed forcedly must be restrained.

For this purpose, it seems important (1) to make a roller and a vane of a combination of materials which seldom adhere to each other, (2) to strengthen the rotor material in order to prevent the roller from being partially removed forcedly from under an adhered portion, and (3) to fully decrease an attacking influence of the vane material to a mating material while maintaining the minimum level of the wear resistance of the vane material.

Combinations of materials according to the invention presumably restrain the roller to wear in particular under the following situations:

(1) Graphite dispersed in at least one of a roller and a vane (only a roller in case of the present invention) at not lower than a predetermined area ratio maintains lubrication conditions at a predetermined level or higher. Carbides which are hard and less likely to adhere when they contact each other than with metal (especially, MC type carbides of a high hardness which are chemically stable), nitride particles of TiN, NbN and so forth which have lower affinity with Fe (i.e., a mating material) than the carbides, and crystallized eutectic structure including iron phosphide, are distributed in at least one of the members at predetermined area ratios or higher. Further, these substances are distributed while projected from the metallic matrix surface owing to differences of the wear resistances, thereby decreasing metal-to-metal contact which easily causes adhesion. Thus, adhesion is restrained to occur with respect to both the members.

(2) The roller material is strengthened by quenching/tempering treatment of the matrix and by including not less than a predetermined area % of crystallized eutectic structure having iron phosphide of a high hardness. Consequently, the roller material is prevented from being partially removed forcedly in the above-described manner.

(3) The vane material contains carbides of not larger than a predetermined size, and includes TiN and NbN which have low affinity with Fe in the mating material so as to decrease an attacking influence on the mating material.

DETAILED DESCRIPTION OF THE INVENTION

Figure 1A:
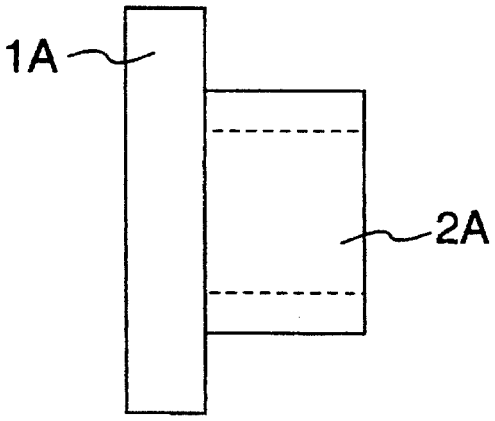
FIG. 1*a* is a side view schematically showing testing members for measuring seizure occurrence, contact pressures, and friction coefficients of a vane material and a roller material.

Roller:

Examples of grounds for restrictions of a roller material according to the invention will now be described.

The invention has been achieved by discovering that a roller of the following material is remarkably improved regarding a wear resistance and a contact pressure per unit area at the time of occurrence of seizure with respect to a particular vane material, which will be described later: the roller material having the matrix of tempered martensite in which at least three kinds of dispersed phases mainly comprising graphite of flake, spheroidal or other shapes, carbide ($Fe_3C$), and iron phosphide ($Fe_3P$) coexist.

The roller according to the invention is made of a cast iron which has a hardness HRC 50 or more after heat treatment, and which contains not less than 5 area % of graphite, and not less than 2 area % of crystallized eutectic structure including iron phosphide.

In the invention, as the hardness of the roller after heat treatment is increased, as described above, the roller material is prevented from being partially removed forcedly from under an adhered portion, thereby improving the wear resistance and the anti-seizure property. When a relatively large amount of graphite phase is crystallized as in the roller of the invention, the matrix must be made of tempered martensite structure, and the hardness must be not less than HRC 50 in order to obtain a high wear resistance and a high anti-seizure property. The upper limit of hardness is inevitably determined by an amount of crystallization of the graphite phase. The preferred hardness is not less than HRC 53.

In the invention, the graphite phase which provides a self-lubricative property and an oil lubricative property is an indispensable phase for controlling lubrication conditions with respect to a cylinder and a vane and for restraining the tendency of adhesion. Concerning the shape of graphite, flake graphite provides better results in the sliding-contact property than spheroidal graphite. Concerning the size of graphite, graphite particles as fine as possible are preferred (but it is not a critical element). As an amount of graphite is larger, the sliding-contact property is improved. Consequently, the amount of graphite is set to be not less than 5 area %. However, when graphite is added excessively, the hardness is deteriorated, and also, the mechanical properties are deteriorated, which causes an accident such as breakage of a roller during operation. In the invention, the graphite amount is preferably not more than 14.0 area % although it may vary in accordance with a mating vane material. More preferably, the graphite amount is 6 to 10.0%.

Generally, the structure called steadite is crystallized as ternary eutectic of $Fe_3P$—$Fe_3C$—Fe. This steadite phase is relatively hard, and when phosphorus is added, it becomes more stabler than $Fe_3C$. Thus, the steadite restrains the tendency of the roller material of the invention to adhere and to be partially removed forcedly, thereby remarkably improving the wear resistance and the sliding-contact property. Since the steadite has a particular micro-structure, as will be described later, the steadite is referred to as crystallized eutectic structure including iron phosphide in the invention. This structure is an indispensable phase for the roller of the invention, next to the graphite phase. When an amount of steadite is less than 2 area %, the effect is low. Therefore, the steadite amount is set to be not less than 2 area %. However, when it exceeds 20%, the material becomes brittle, and the castability is deteriorated. Consequently, the steadite amount is preferably not more than 20 area %. More preferably, it is 2.5 to 5 area %.

It should be noted that trace elements of B, Bi, Sb and the like which are added to cast iron on demand can be added so long as addition of such elements is performed without particularly deviating from the spirit of the invention.

Vane:

Next, example of grounds for restrictions of a vane material according to the invention will be described.

The vane material according to the first feature of the invention has a hardness HRC 70 or more after heat treatment, and contains not less than 25 area % of undissolved carbides and nitride particles in total, the undissolved carbides including not less than 10 area % of MC type carbides, the nitride particles including at least one of TiN and NbN of not less than 5 area %, the undissolved carbides and the nitride particles having a mean grain size of not more than 5 μm.

Concerning the operational mechanism of a vane, one limited part of the distal end of the vane is in sliding contact with the outer peripheral surface of a roller. Therefore, the vane must have a high wear resistance relative to the roller.

A mere improvement of the wear resistance of the vane can be generally achieved by increasing hardness of the vane and increasing the content of hard particles of carbides or the like. In this case, however, improper increases in the amounts of these particles cause more attacking influence with respect to the roller material whose hardness is lower than that of the vane material, thereby easily inducing scoring (attacking) of the roller material.

Prior to the present application, the inventors found that the following improved vane material exhibited a rather excellent conformability with the roller material of the invention: the improved vane material having a hardness HRC 65 or more after quenching and tempering treatment, and containing not less than 12 area % of undissolved carbides, the undissolved carbides including not less than 10 area % of MC type carbides, the undissolved carbides having a mean grain size of not more than 3 μm. However, it was also found that, in a certain kind of compressor, the anti-seizure property and the wear resistance of this vane material were inadequate, and that these properties must be further improved.

Thus, the inventors found that, in order to lessen attacking with respect to the roller material and to improve the anti-seizure property and the wear resistance of the roller and the vane to a further degree, it is effective to add appropriate amounts of the above-mentioned TiN and NbN particles so as to increase amounts of distributions of the undissolved carbides and the carbide particles, and to increase hardness of the vane material.

As described above, the particles of TiN and the like have lower affinity with Fe than carbides. Consequently, these particles can restrain the tendency of adhesion with Fe of a mating material more effectively than the carbides, thus achieving the improvement of the anti-seizure property and the wear resistance of the roller and the vane.

One or two kinds of such nitride particles can be added. When an amount of the nitride particles is less than 5 area %, the effect is insufficient. Therefore, the amount of the nitride particles is set to be not less than 5 area %. Preferably, it is not less than 7 area %. However, when it exceeds 25 area %, the economical effect is lost, and also, the toughness of the vane is degraded.

In the case of the above-described improved vane material, the carbides are made finer to reduce attacking with respect to the roller material, and the resultant decrease in wear resistance of the vane material itself is compensated for by increasing hardness of the vane material, i.e., by adding a predetermined amount of carbides. On the basis of substantially the same idea, in the vane according to the invention, both the maximum grain size and the mean grain size of the undissolved carbides and the nitride particles must be made as small as possible. The undissolved carbides and the nitride particles must have a mean grain size of not more than 5 μm, and also, their maximum grain size is preferably restricted to, for example, not more than 7 μm. The preferred mean grain size is not more than 3 μm.

When the hardness is less than HRC 70, the decrease in wear resistance of the vane material itself caused by restricting the mean grain size of the carbides of the vane material cannot be compensated for, so that the wear resistance will be insufficient. Therefore, the hardness is set to be not less than HRC 70, and preferably, not less than HRC 71.

The total amount of the undissolved carbides and the nitride particles is set to be not less than 25 area % (preferably, not less than 30 area %). The undissolved carbides especially include not less than 10 area % (preferably, not less than 12 area %) of MC type carbides which have a high hardness and are stable. The nitride particles include at least one of TiN and NbN of not less than 5 area %. If the amounts of the undissolved carbides and the nitride particles are less than the predetermined amounts, the tendency of adhesion with the roller cannot be fully restrained, so that the wear resistance and the anti-seizure property will be inadequate.

As described above, the vane material of the invention includes TiN, NbN and a large amount of carbides, especially a large amount of VC carbides which are apt to be coarse carbides, and also, such carbides must be made finer in the foregoing manner. Therefore, the vane material is preferably manufactured by a powder metallurgy method.

In order to improve the anti-seizure property, the vane material is preferably subjected to a surface treatment such as nitriding, oxynitriding, sulphonitriding and so forth. Further, in order to improve the surface hardness and the lubricative property, the vane material is preferably subjected to a homo-treatment for forming a porous iron oxide film mainly comprising triiron tetroxide on the surface of the vane.

It has already been described above that the predetermined amounts of TiN and NbN particles are added to the material of the vane according to the second feature of the invention. Functions of the other elements of the vane material and examples of grounds for restricting amounts of the elements will now be described.

Carbon combines with W, Mo, V or the like which are added with carbon, so as to form hard carbides, thus enhancing the wear resistance of the vane. Also, in the form of carbides, carbon reduces opportunities of metal-to-metal contact with a mating material, thus effectively decreasing adhesion. Further, carbon partially dissolves into the matrix and increases hardness of the matrix, thereby improving the wear resistance. Therefore, in accordance with amounts of carbide forming elements such as W, Mo, V and so on, the optimum amount of carbon is determined. According to the invention, when the carbon amount is less than 2.0%, a sufficient hardness of the matrix cannot be obtained, and an amount of formed carbides is small. When the carbon amount exceeds 4.0%, the toughness is degraded, and the hot workability is deteriorated. Consequently, the carbon amount is set to be 2.0 to 4.0 %. Preferably, the carbon amount is within a range of 2.5 to 3.8%, and more preferably, it is within a range of 3.0 to 3.6%.

Si improves the steel quality as a deoxidizing element, and dissolves into the matrix so as to increase hardness of the matrix. However, when an amount of Si exceeds 2.0%, toughness is degraded. Therefore, the Si amount is set to be not more than 2.0%. Preferably, the Si amount is not more than 1.5%.

Similarly, Mn improves the steel quality as a deoxidizing element. However, when an amount of Mn exceeds 1.5%, the hardness after quenching is lowered. Therefore, the Mn amount is set to be not more than 1.5% Preferably, the Mn amount is not more than 1.0%.

However, Si and Mn are originally deoxidizers, and consequently, they are optional additive elements except when Si is employed for increasing the hardness.

Cr forms carbides and produces an effect of enhancing the wear resistance and restraining the adhesion tendency. Also, Cr dissolves into the matrix to provide quenchability and to improve corrosion resistance of the matrix. Because an alternative fluorocarbon HFC has a high hygroscopic property, and because a lubricant is decomposed to produce an acid such as a carboxylic acid, the vane is operated in a lightly corrosive environment. Consequently, abnormal wear of the vane is presumably not only simple abrasive type wear but also wear caused by a mechanism including corrosion. In this case, in addition to Cr, dissolution of W, Mo and Co into the matrix, which will be described below, enhances corrosion resistance of the vane and decreases wear. When an amount of Cr is less than 2.5% the above-described effect is small, and when it exceeds 8.0%, a high hardness can not be obtained after heat treatment. Therefore, the Cr amount is set to be 2.5 to 8.0%. Preferably, the Cr amount is within a range of 3.0 to 6.0%, and more preferably, it is within a range of 3.5 to 5.5%. However, when the vane is subjected to a surface treatment, e.g., nitriding, the Cr amount is preferably within a range of 5.0 to 8.0%.

W and Mo combine with carbon and form $M_2C$ or $M_6C$ type carbides to restrain the adhesion tendency, thus enhancing the wear resistance and the anti-seizure property. Further, after dissolving into the matrix, W and Mo are precipitated by tempering and produce an effect of increasing hardness of the matrix. Mo also serves to prevent corrosion due to carboxylic acid. Mo produces an effect twice larger than tungsten. At least one of not more than 30% (preferably not more than 20 % of tungsten and not more than 20% (preferably not more than 15%) of Mo is added. However, when an amount of W and Mo in terms of "W+2Mo" is less than 20%, the foregoing effect is small, and when it exceeds 40%, toughness is degraded. Therefore, the amount of W and Mo in terms of "W+2Mo" is set to be 20 to 40%. Preferably, it is 24 to 36%.

Vanadium is an element which has an important function in the invention. More specifically, vanadium combines with carbon and forms MC-type carbides which are chemically stable and have a high hardness. When these carbides are dispersed finely and uniformly over the surface of the vane, the wear resistance and the anti-seizure property can be improved more effectively than other types of carbides. Although the effect may vary in accordance with the structure of a compressor and a required durability, anti-seizure property and wear resistance are increased gradually when totally not less than 3.0% of vanadium is added. Especially when the vanadium amount is 6.0% or more, the effect is remarkable. When the amount of vanadium is less than 3.0%, the above-described effect is insufficient, and when it exceeds 15%, coarse VC-carbides are crystallized, and atomizing is difficult, and also, machining is difficult. For these reasons, the vanadium amount is set to be 3.0 to 15%. Preferably, the vanadium amount is within a range of 6.0 to 12.0%.

Similarly, Co is an element which has an important function in the invention. Co dissolves into the matrix to produce an effect of increasing hardness of the matrix. Co also produces a significantly high effect of the invention to prevent corrosion due to carboxylic acid. On the other hand, as an amount of Co is larger, the cost is increased, so that Co is added within a range for obtaining a hardness HRC 70 or more. Normally, not more than 15% of Co is enough.

It should be noted that the hardness of the vane according to the second feature of the invention is set to be not less than HRC 70 for substantially the same reason as the vane according to the first feature.

EXPERIMENTS

Experiment 1

Concerning each of roller materials with which experiments were conducted, Table 1 shows a chemical composition, a hardness after heat treatment, and area ratios of graphite, crystallized eutectic structure including iron phosphide (referred to as steadite in Table 1), and carbides.

In Table 1, a specimen No. 10 is a cast iron in which eutectic graphite is dispersed in the ferrite matrix, and a specimen No. 21 is a low alloy cast iron which is most commonly used as a roller material at present. Specimens Nos. 22 to 24 are cast irons produced by continuous casting, and the specimen No. 24 is a cast iron in practical use as a roller material.

Specimens Nos. 30 and 31 are cast irons in which spheroidal graphite is dispersed in the bainite matrix. Specimens Nos. 40 and 41 are cast irons in which crystallized eutectic structure including iron phosphide, and flake or spheroidal graphite are dispersed in the tempered martensite matrix, and the specimens Nos. 40 and 41 are roller materials according to the present invention.

Specimens Nos. 50 and 51 are wear resistant cast irons in practical use as roller materials. The specimen 50 is a cast iron of the type in which graphite and carbides coexist, and the specimen 51 is white alloy-cast iron in which a large amount of $M_7C_3$ type eutectic carbides are dispersed. A specimen No. 60 is a cast iron in which spheroidal graphite and carbides are dispersed in the austenite matrix containing a large amount of Ni.

In Table 1, any of those specimens which have hardness greater than HRC 50 has the tempered martensite matrix.

Figure 3:
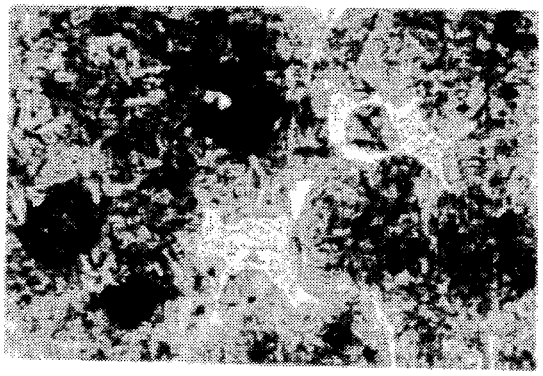
FIG. 3 is a microphotograph showing an example of a metallic micro-structure of a roller material according to the present invention.

FIG. 3 shows one example of a micro-structure of the specimen No. 40 (magnification: 200). In the figure, black round dots indicate graphite, and white and light gray dotted portions and white mass portions indicate crystallized eutectic structure including iron phosphide which is called steadite. The matrix is tempered martensite.

Incidentally, FIG. 3 is taken in view of a portion where graphite and crystallized eutectic structure including iron phosphide particularly gather so that it does not accord with the area ratio shown in Table 1.

TABLE 1

| | | Composition (%) | | | | | | | | | Hardness | Graphite Area Ratio | Steadite Area Ratio | Carbide Area Ratio |
|---|---|---|---|---|---|---|---|---|---|---|---|---|---|---|
| No. | Kind | C | Si | Mn | P | S | Ni | Cr | Mo | Fe | (HRC) | (%) | (%) | (%) |
| 10 | Hypo-eutectic D-type Graphite Cast Iron | 3.45 | 2.93 | 0.91 | 0.066 | 0.062 | 1.63 | 0.21 | 0.02 | Bal | HV 185 | 10.9 | 0 | 0 |
| 21 | Mo—Ni—Cr Flake Graphite Cast Iron | 3.10 | 2.16 | 0.73 | 0.186 | 0.010 | 0.25 | 0.56 | 0.22 | " | 53.2 | 6.3 | 1.5 | 0 |
| 22 | Continuous-Casting Eutectic Graphite Cast Iron | 3.53 | 2.57 | 0.56 | 0.099 | 0.013 | 0.02 | 0.10 | 0.09 | " | 52.5 | 10.2 | 1.4 | 0 |
| 23 | Continuous-Casting Eutectic Graphite Cast Iron | 3.65 | 2.85 | 0.47 | 0.098 | 0.011 | 0.07 | 0.04 | 0.01 | " | 57.0 | 11.1 | <1.0 | 0 |
| 24 | Continuous-Casting Flake Graphite Cast Iron | 3.48 | 2.73 | 0.65 | 0.101 | 0.012 | 0.01 | 0.10 | 0.09 | " | 57.0 | 11.1 | 1.0 | 0 |
| 30 | Bainite Cast Iron | 3.37 | 2.60 | 0.30 | 0.020 | 0.005 | 0.02 | 0.02 | 0.27 | " | 36.4 | 13.9 | <1.0 | 0 |
| 31 | High-Hardness Bainite Cast Iron | 3.28 | 4.30 | 0.38 | 0.017 | 0.010 | 0.02 | 0.01 | 0.38 | " | 42.4 | 10.4 | <1.0 | 0 |
| 40 | Steadite-Dispersed Flake Graphite Cast Iron | 2.90 | 2.00 | 0.49 | 0.643 | 0.110 | 0.01 | 0.01 | 0.01 | " | 56.2 | 8.1 | 2.9 | 0 |
| 41 | Steadite-Dispersed Spheroidal Graphite Cast Iron | 3.38 | 4.56 | 0.46 | 0.585 | 0.015 | 0.01 | 0.01 | 0.01 | " | 55.2 | 5.1 | 3.3 | 0 |
| 50 | Grain Cast Iron | 3.40 | 0.58 | 0.62 | 0.020 | 0.005 | 4.09 | 1.86 | 0.33 | " | 52.5 | 1.2 | 0 | 10.0 |
| 51 | White Alloy Cast Iron | 2.70 | 0.44 | 0.72 | 0.022 | 0.013 | 1.30 | 16.78 | 1.39 | " | 45.0 | 0 | 0 | 11.0 |
| 60 | Niresist Spheroidal Graphite Cast Iron | 2.83 | 2.72 | 0.67 | 0.020 | 0.013 | 20.26 | 1.90 | 0.01 | " | HV 160 | 7.1 | 0 | 1.0 |

Concerning each of vane materials with which evaluation tests were performed, Table 2 shows a chemical composition, a hardness after quenching and tempering heat treatment, a manufacturing method of material, kinds and area ratios (%) of undissolved carbides and nitride particles (referred to as existing carbides and the like in Table 2) after quenching-tempering heat treatment, and mean grain sizes of undissolved carbides and nitride particles having grain sizes of not smaller than 1.0 μm when the vane material was in a state of a product which could be measured by an image processing apparatus. In Table 2, JIS SUJ2, JIS SUS440C and JIS SKH51 are materials which are widely used as vane materials for refrigerators, air-conditioners and the like at present.

Comparative specimens were manufactured by two kinds of methods, i.e., a method of melting each material normally, molding an ingot, forging and rolling it (Melt process), and a powder method (PM) of forming a green compact of gas-atomized powder by a hot isostatic pressing method (HIP). In the latter method, as compared with the former, alloy powder manufactured by super-rapid cooling solidification is used as a starting material, and consequently, existing undissolved carbides are remarkably uniform and fine.

Specimens according to the invention were manufactured by a method of fining powder of irregular forms produced by a water-atomizing method, into powder of not more than 10 μm by means of an Attoritor, adding proper amounts of VC, TiN and NbN powders to the powder, and sintering the mixture (which method is referred to as ST in Table 2). Since plastic working of such high-alloy materials can not be effected, the materials which have been press-compacted by sintering are formed into desired product shapes by mechanical working (lathe machining and grinding).

Figure 4:
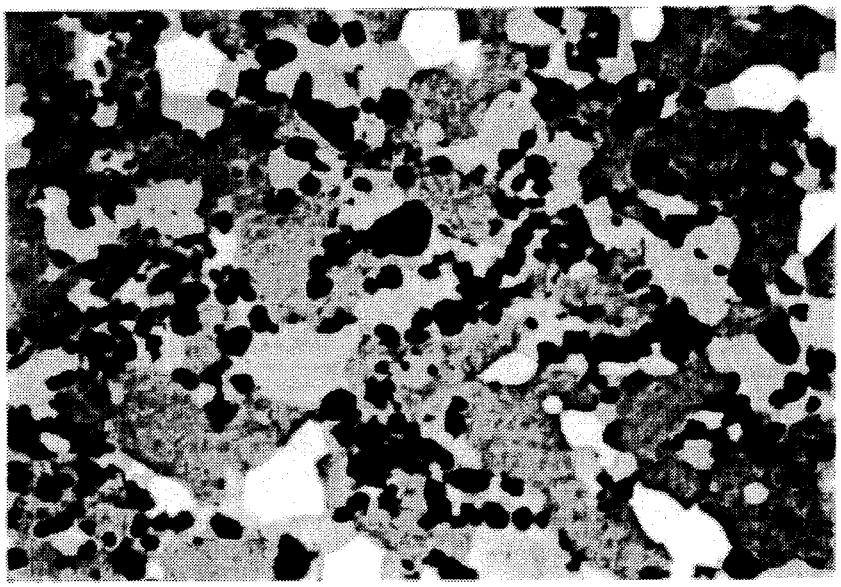
FIG. 4 is a microphotograph showing an example of a metallic micro-structure of a vane material according to the invention.

FIG. 4 shows a microscope structure of a steel L in Table 2 (magnification: 4000). In the sketch, black particles are TiN particles, white polygonal particles are $M_6C$ type carbides, light gray particles are MC type carbides, and the rest is the matrix.

Figure 1B:
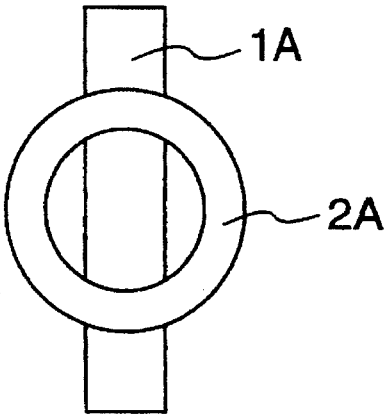
FIG. 1*b* is a front elevational view schematically showing the testing members of FIG. 1*a;*
Figure 2:
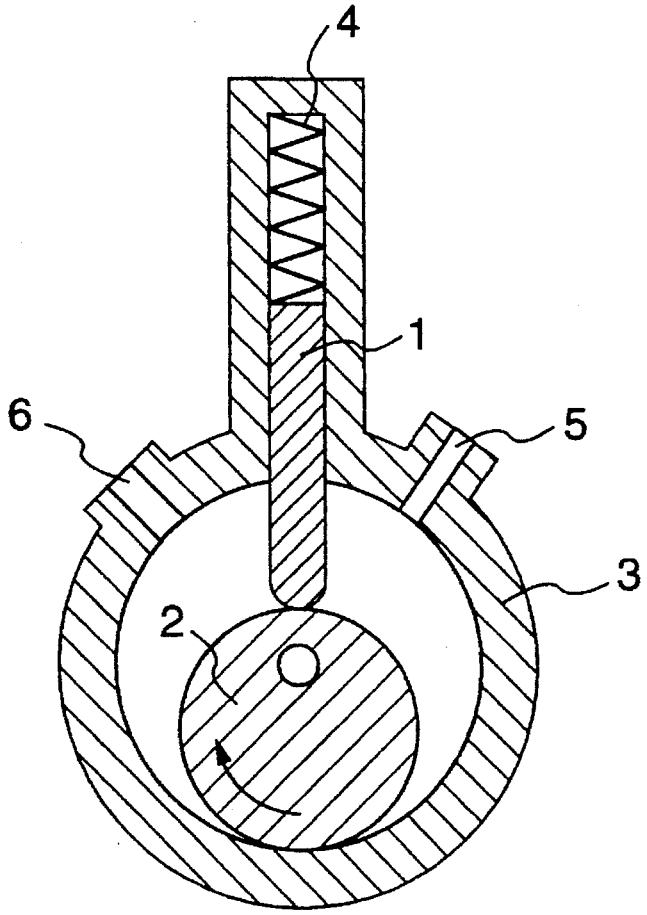
FIG. 2 is a cross-sectional view showing a structure of a rotary type compressor.

An annular test piece 2A (having an outer diameter of 25.6 mm and an inner diameter of 20.0 mm) made of a roller material shown in Table 1 was contacted with a square bar 1A (10×10×40 mm) made of a vane material shown in Table 2 in such a positional relationship as shown in FIGS. 1*a* and 1*b*, and then, the test piece 2A was immersed in a polyol ester lubricant and rotated around its own axis. Every time the test piece 2A was rotated for one minute while maintaining the sliding-contact relationship between the test piece 2A and the bar 1A under the conditions that the contact area was 0.58 $cm^2$, the sliding velocity was 2.73 m/sec, and the initial contact pressure per unit area was 0.981 MPa (10 $kgf/cm^2$), the pressure was increased by 0.981 MPa (10 $kgf/cm^2$), and a contact pressure per unit area when seizure occurred and a friction coefficient under a predetermined contact pressure were measured.

TABLE 2

| | Steel Kind | Composition (%) C | Si | Mn | Cr | W | Mo | V | Co | Fe | TiN and the Like | Hardness (HRC) |
|---|---|---|---|---|---|---|---|---|---|---|---|---|
| Comparative Steel | JIS SUJ2 | 1.00 | 0.20 | 0.30 | 1.00 | — | — | — | — | Bal | — | 52.8 |
| | JIS SUS440C | 0.92 | 0.37 | 0.41 | 16.97 | — | 0.51 | 0.06 | — | " | — | 57.2 |
| | JIS SKD11 | 1.39 | 0.25 | 0.37 | 12.30 | — | 0.86 | 0.24 | — | " | — | 59.0 |
| | JIS SKH51 (M) | 0.89 | 0.23 | 0.28 | 3.87 | 6.06 | 4.95 | 1.92 | — | " | — | 65.3 |
| | JIS SKH51 (P) | 0.88 | 0.31 | 0.27 | 4.01 | 6.22 | 4.87 | 1.97 | — | " | — | 65.2 |
| | JIS A | 2.14 | 0.32 | 0.32 | 4.21 | 11.49 | 2.53 | 6.96 | 7.92 | " | — | 66.5 |
| | JIS B | 1.57 | 0.27 | 0.26 | 4.11 | 14.10 | — | 5.01 | 4.90 | " | — | 66.3 |
| | JIS C | 2.01 | 0.29 | 0.27 | 4.03 | 9.71 | 8.03 | 5.10 | 9.50 | " | — | 69.8 |
| | JIS D | 1.30 | 0.28 | 0.23 | 4.10 | 6.10 | 5.23 | 3.20 | 8.02 | " | — | 67.8 |
| | JIS E | 1.90 | 0.31 | 0.25 | 10.00 | 4.03 | 6.21 | 5.23 | 3.00 | " | — | 66.1 |
| | JIS F | 1.35 | 0.60 | 0.24 | 5.22 | 3.13 | 6.02 | 3.81 | — | " | — | 65.0 |
| Invention Steel | JIS G | 2.05 | 0.43 | 0.43 | 3.90 | 10.3 | 6.10 | 5.50 | 8.00 | " | 9.0 | 70.3 |
| | JIS H | 2.95 | 0.33 | 0.25 | 3.80 | 9.00 | 7.20 | 8.00 | 9.80 | " | 10.0 | 70.8 |
| | JIS I | 3.85 | 0.27 | 0.33 | 3.83 | 9.60 | 7.40 | 13.50 | 9.70 | " | 9.6 | 71.2 |
| | JIS J | 3.90 | 0.36 | 0.41 | 3.90 | 9.30 | 7.60 | 8.00 | 9.40 | " | 5.0 | 70.2 |
| | JIS K | 3.02 | 0.25 | 0.25 | 3.80 | 9.50 | 7.20 | 8.10 | 0.80 | " | 10.0 | 70.5 |
| | JIS L | 3.60 | 0.44 | 0.23 | 3.50 | 14.60 | 8.20 | 13.50 | 9.80 | " | 15.0 | 73.5 |
| | JIS M | 3.80 | 0.28 | 0.28 | 4.10 | 15.10 | 8.50 | 14.10 | 8.50 | " | NbN 15.0 | 72.8 |
| | JIS N | 3.11 | 0.31 | 0.31 | 7.42 | 15.40 | 10.30 | 8.30 | 8.50 | " | TiN 9.0 | 70.4 |

| | Steel Kind | Manufacturing Method | Existing Carbides and the Like: Kind | Area Ratio (%) | Kind | Area Ratio (%) | Kind | Area Ratio (%) | Mean Grain Size of Carbides and the Like (μm) |
|---|---|---|---|---|---|---|---|---|---|
| Comparative Steel | JIS SUJ2 | Melt | $M_3C$ | 6.1 | — | — | — | — | 1.0 |
| | JIS SUS440C | " | $M_{23}C_6$ | 14.0 | — | — | — | — | 8.0 |
| | JIS SKD11 | " | $M_7C_3$ | 14.0 | — | — | — | — | 9.0 |
| | JIS SKH51 (M) | " | MC | 1.5 | $M_6C$ | 7.2 | — | — | 5.0 |
| | JIS SKH51 (P) | PM | MC | 1.8 | $M_6C$ | 7.1 | — | — | 1.3 |
| | JIS A | PM | MC | 18.0 | $M_6C$ | 5.4 | — | — | 1.3 |
| | JIS B | PM | MC | 15.3 | $M_6C$ | 3.2 | — | — | 1.2 |
| | JIS C | PM | MC | 16.6 | $M_6C$ | 16.5 | — | — | 1.3 |
| | JIS D | PM | MC | 12.0 | $M_6C$ | 11.0 | — | — | 1.3 |
| | JIS E | PM | MC | 14.3 | $M_6C$ | 17.2 | — | — | 1.3 |
| | JIS F | PM | MC | 10.3 | $M_6C$ | 2.1 | — | — | 1.3 |
| Invention Steel | JIS G | ST | MC | 10.7 | $M_6C$ | 9.4 | TiN | 9.5 | 3.2 |
| | JIS H | " | MC | 14.5 | $M_6C$ | 8.4 | TiN | 10.2 | 2.8 |
| | JIS I | " | MC | 26.5 | $M_6C$ | 8.6 | TiN | 9.8 | 3.0 |
| | JIS J | " | MC | 13.9 | $M_6C$ | 8.0 | TiN | 7.5 | 2.6 |
| | JIS K | " | MC | 14.2 | $M_6C$ | 8.3 | TiN | 8.9 | 2.8 |
| | JIS L | " | MC | 26.2 | $M_6C$ | 10.2 | TiN | 15.3 | 3.1 |
| | JIS M | " | MC | 27.5 | $M_6C$ | 11.3 | NbN | 12.3 | 2.5 |
| | JIS N | " | MC | 13.1 | $M_6C$ | 13.5 | TiN | 10.5 | 3.3 |

In one of the above-described tests, the steel L of Table 2 was used as a vane material, and the specimens of Table 1 were used as a roller material. In this test, contact pressures per unit area upon occurrence of seizure (seizure occurrence contact pressures) when the contact pressure per unit area was 9.81 MPa (100 $kgf/cm^2$), and wear amounts of rollers, were measured, and the results are shown in Table 3.

Seizure occurrence contact pressures of roller materials Nos. 10 and 60 having low hardness are low.

Although introduction of data is omitted, it was found that the seizure occurrence contact pressure and the wear amount are varied more largely by changing the roller materials than by changing the vane materials, and that selection of material combination is very important.

Of the roller materials, obviously, seizure occurrence contact pressures of the specimens Nos. 40 and 41 including not less than 2 area % of crystallized eutectic structure having iron phosphide are very high.

A seizure occurrence contact pressure of the specimen No. 31 which has the bainite matrix and has a high hardness is high. However, a large amount of residual austenite exists in this material, and consequently, the specimen No. 31 involves a problem of dimensional change in accordance with time which must be avoided as a roller material. Wear amounts of the specimens Nos. 40, 41 and 30, 31, which are an important element for this type of compressor, are small. From Table 3, it can be understood that the combinations of materials according to the invention are suitable.

TABLE 3

| Vane Material | | Roller Material | Seizure Occurrence Contact Pressure MPa (kgf/cm$^2$) | Roller Wear Amount $\frac{mg \times 10^{-3}}{m \cdot hr}$ |
|---|---|---|---|---|
| L | 10 | Hypo-eutectic D-type Graphite Cast Iron | 24.5 (250) | 0.180 |
| " | 21 | Mo—Ni—Cr Flake Graphite Cast Iron | 78.5 (800) | 0.012 |
| " | 22 | Continuous-Casting Eutectic Graphite Cast Iron | 58.8 (600) | 0.023 |
| " | 23 | Continuous-Casting Eutectic Graphite Cast Iron | 63.7 (650) | 0.035 |
| " | 24 | Continuous-Casting Flake Graphite Cast Iron | 66.7 (680) | 0.028 |
| " | 30 | Bainite Cast Iron | 71.6 (730) | 0.011 |
| " | 31 | High-Hardness Bainite Cast Iron | 83.4 (850) | 0.010 |
| " | 40 | Steadite-Dispersed Flake Graphite Cast Iron | 117.7(1200) | 0.009 |
| " | 41 | Steadite-Dispersed Spheroidal Graphite Cast Iron | 107.9(1100) | 0.007 |
| " | 50 | Grain Cast Iron | 73.5 (750) | 0.021 |
| " | 51 | White Alloy Cast Iron | 58.8 (600) | 0.015 |
| " | 60 | Niresist Spheroidal Graphite Cast Iron | 29.4 (300) | 0.098 |

Table 4 shows measurement results of friction coefficients at a contact pressure per unit area of 9.81 MPa (100 kgf/cm$^2$) and seizure occurrence contact pressures when the specimen 40 of Table 1 was used as a roller material and various kinds of vane materials were used.

Of the comparative specimens including the materials in practical use as vane materials, a seizure occurrence contact pressure of the Melt material was 9.8 to 25.5 MPa (100 to 260 kgf/cm$^2$), and a seizure occurrence contact pressure of the powder metallurgy (PM) material was 13.7 to 37.3 MPa (140 to 380 kgf/cm$^2$). When the Melt material and the PM material are compared with each other, the seizure occurrence contact pressure of the Melt material including carbides having a small grain size is higher. On the other hand, seizure occurrence contact pressures of the vane materials according to the invention were by far higher, and they were 47.1 to 117.7 MPa (480 to 1200 kgf/cm$^2$).

TABLE 4

| Vane Material | | Roller Material | Friction Coefficient | Seizure Occurrence Contact Pressure MPa | Seizure Occurrence Contact Pressure kgf/cm$^2$ |
|---|---|---|---|---|---|
| Comparative Steel | JIS SUJ2 | No. 40 | — | 9.8 | 100 |
| | JIS SUS440C | " | — | 25.5 | 260 |
| | JIS SKD11 | " | — | 12.7 | 130 |
| | JIS SKH51 (M) | " | — | 11.8 | 120 |
| | JIS SKH51 (P) | " | — | 13.7 | 140 |
| | JIS A | " | — | 28.0 | 285 |
| | JIS B | " | — | 36.3 | 370 |
| | JIS C | " | — | 37.3 | 380 |
| | JIS D | " | — | 25.5 | 260 |
| | JIS E | " | — | 19.6 | 200 |
| | JIS F | " | — | 27.5 | 280 |
| Invention Steel | JIS G | " | 0.002 | 51.0 | 520 |
| | JIS H | " | 0.003 | 56.9 | 580 |
| | JIS I | " | 0.003 | 80.4 | 820 |
| | JIS J | " | 0.004 | 59.8 | 610 |
| | JIS K | " | 0.002 | 47.1 | 480 |
| | JIS L | " | 0.002 | 117.7 | 1200 |
| | JIS M | " | 0.001 | 78.5 | 800 |
| | JIS N | " | 0.001 | 73.5 | 750 |

Table 5 shows measurement results of friction coefficients and seizure occurrence contact pressures of typical combinations of vane and roller materials.

The "carbon" is a carbon material impregnated with about 42 wt % of aluminum, and is used for a vane as a non-metallic sliding material. In comparison with a specimen A and JIS SKH51, a seizure occurrence contact pressure of the carbon vane is remarkably high. However, mechanical properties of the carbon vane are extremely inferior, which results in a problem of breakage during machining, transportation and operation. The carbon vane also involves a problem in absolute strength when it is applied to an air-conditioner which has a particularly large pressure difference.

A ratio of improvement of a roller No. 40 in which crystallized eutectic structure including iron phosphide is dispersed according to the invention, with respect to a comparative specimen No. 24 is 1.3 times (11.8/8.8) when a mating vane is made of JIS SKH51, but it is 1.8 times (117.7/66.7) when a mating vane is made of a specimen L according to the invention. It can be understood that the roller material No. 40 has high conformability with the vane material L. Moreover, it can be understood that this combination exhibits a low friction coefficient and a high absolute value of seizure occurrence contact pressure. A roller material No. 41 is not particularly inferior to No. 40.

TABLE 5

| | Vane | Roller Material | | Friction Coefficient | Seizure Occurrence Contact Pressure |
|---|---|---|---|---|---|
| | Material | No. | Kind | at 9.8 MPa | MPa (kgf/cm$^2$) |
| Comparative Steel | A | 24 | Continuous-Casting Flake Graphite Cast Iron | — | 15.7 (160) |
| | A | 40 | Steadite-Dispersed Flake Graphite Cast Iron | 0.003 | 28.0 (285) |
| | A | 41 | Steadite-Dispersed Spheroidal Graphit Cast Iron | 0.003 | 23.5 (240) |
| | Carbon | 24 | Continuous-Casting Flake Graphite Cast Iron | 0.012 | 40.2 (410) |
| | Carbon | 40 | Steadite-Dispersed Flake Graphite Cast Iron | — | * |
| | Carbon | 41 | Steadite-Dispersed Spheroidal Graphite Cast Iron | — | * |
| | SKH51 (Melt) | 24 | Continuous-Casting Flake Graphite Cast Iron | 0.010 | 8.8 (90) |
| | SKH51 (Melt) | 40 | Steadite-Dispersed Flake Graphite Cast Iron | 0.007 | 11.8 (120) |
| Invention Steel | L | 24 | Continuous-Casting Flake Graphite Cast Iron | 0.024 | 66.7 (680) |
| | L | 40 | Steadite-Dispersed Flake Graphite Cast Iron | 0.002 | 117.7(1200) |
| | L | 41 | Steadite-Dispersed Spheroidal Graphite Cast Iron | 0.002 | 107.9(1100) |

*Not Less than 49.0 MPa
Not Less than 500 kgf/cm$^2$

Experiment 2

Table 6 shows measurement results of improvements of seizure occurrence contact pressures with respect to a roller of No. 41 when a vane material L was not subjected to a surface treatment and when it was subjected to various kinds of surface treatments. It can be understood that, although any of the surface treatments is effective, sulphonitriding treatment and oxynitriding treatment for forming a porous layer on the surface are particularly effective.

TABLE 6

| Vane | Roller | Surface Treatment | Seizure Occurrence Contact Pressure MPa (kgf/cm$^2$) |
|---|---|---|---|
| L | No. 41 | None | 107.9(1100) |
| " | " | Sulphonitriding Treatment | 132.4(1350) |
| " | " | Oxynitriding Treatment | 127.5(1300) |
| " | " | Soft Nitriding Treatment | 117.7(1200) |
| " | " | Homo-Treatment | 115.7(1180) |

Experiment 3

Rollers made of the conventional materials Nos. 21 and 24 and the invention material No. 41, and vanes made of JIS SKH51, the invention material L and the "carbon" were set in actual rotary type compressors, and their durabilities were compared.

Materials employed for the experiment and conditions of heat treatment were the same as Experiment 1. The sliding velocity was 1.5 m/sec, the load was 98 N (10 kgf), the lubricant was polyol ester oil, and the refrigerant was R134a. Test time was 2000 hours. Evaluations were effected by wear amounts of rollers and vanes. The results are shown in Table 7.

Normally, it is necessary to guarantee a compressor for a durability of about 10 years. For this purpose, in such a short test, it is a tentative aim to maintain wear of the roller material at not more than 100 μm and wear of the vane material at not more than 20 μm.

When a vane was made of the specimen L, a roller was made of the specimen No. 41, and a surface treatment was not performed, wear of the roller was 81 μm, and wear of the vane was 8.1 μm. Thus, the above-mentioned tentative aim was fully attained. Obviously, the original purpose regarding the durability was accomplished.

From Table 7, it can be understood that when the roller material to be mated with a vane made of JIS SKH51 is changed from the conventional materials Nos. 21 and 24 to the invention material No. 41, the wear amount of the roller material can be decreased from 400–410 μm to 300 μm, which is a decrease to about 75–73%. When the invention material L (without surface treatment) is used as a vane material, the wear amount of the roller material can be decreased from 115–103 μm to 81 μm, which is a decrease to about 79–70%, and when the invention material L subjected to surface treatment is used, the wear amount of the roller material can be decreased from 89–80 μm to 50 μm, which is a decrease to about 53–56%, or decreased from 88–90 μm to 43 μm, which is a decrease to about 49–48%.

As a result of investigation of wear amounts of vanes, it was found that when the roller material to be mated with a vane made of JIS SKH51 is changed from the materials Nos. 21 and 24 to the material No. 41, the wear amount of the vane can be decreased to 56–45%, and when the invention material L subjected to surface treatment is used as a vane material, the wear amount of the vane can be largely decreased to 38 to 14%.

TABLE 7

| | Vane Material | | | | | |
|---|---|---|---|---|---|---|
| | SKH51 | L | | | | |
| Roller Material | No Surface Treatment | No Surface Treatment | Oxy-nitriding | Sulpho-nitriding | Carbon — | Evaluation Item |
| No. 21 | 400 | 115 | 89 | 90 | 230 | Roller Wear (μm) |
| | 55 | 19 | 21 | 20 | 30 | Vane Wear (μm) |
| No. 24 | 410 | 103 | 80 | 88 | 110 | Roller Wear (μm) |
| | 45 | 22 | 9.9 | 13 | 50 | Vane Wear (μm) |
| No. 41 | 300 | 81 | 50 | 43 | 70 | Roller Wear (μm) |
| | 25 | 8.1 | 3.0 | 5 | 30 | Vane Wear (μm) |

As will be apparent from the above, a rotary type compressor according to the present invention comprises a roller made of a cast iron in which a predetermined amount of flake or spheroidal graphite and a predetermined amount of crystallized eutectic structure including iron phosphide are dispersed in the tempered martensite matrix, and a vane made of a material in which a predetermined amount of carbides and nitride particles having a predetermined size are dispersed. When gas employed in the compressor is hydrofluorocarbon (HFC) which offers severe lubrication conditions, such a combination of the roller material and the vane material exhibits an excellent seizure resistance and prevents mutual wear, thereby enabling long-term operation of the compressor.

What is claimed is:

1. A rotary type compressor comprising a cylinder, a roller and a vane, wherein the roller comprises a cast iron which has a hardness of HRC 50 or more after quenching and tempering heat treatment, said cast iron comprising not less than 5 area % of graphite and not less than 2 area % of eutectic structure including iron phosphide, and the vane comprises an iron alloy which has a hardness of HRC 70 or more after quenching and tempering heat treatment, said iron alloy comprising not less than 25 area % of undissolved carbides and nitride particles in total, said undissolved carbides including not less than 10 area % of MC type carbides, said nitride particles including at least one of TiN and NbN of not less than 5 area %, said undissolved carbides and said nitride particles having a mean grain size of not more than 5 μm.

2. A rotary type compressor according to claim 1, wherein said vane is subjected to a surface treatment of at least one of nitriding, oxynitriding, sulphonitriding and homo-treatment.

3. A rotary type compressor comprising a cylinder, a roller and a vane, wherein the roller comprises a cast iron which has a hardness of HRC 50 or more after quenching and tempering heat treatment, said cast iron comprising not less than 5 area % of graphite, and not less than 2 area % of crystallized eutectic structure including iron phosphide, and the vane comprises an iron alloy including at least one of TiN and NbN particles of not less than 5 area %, said TiN and NbN particles having a mean grain size of not more than 5 μm, said iron alloy essentially comprising, by weight, 2.0 to 4.0% of C, not more than 2.0% of Si, not more than 1.5% of Mn, 2.5 to 8.0% of Cr, at least one of: not more than 30% of W and not more than 20% of Mo in a range of 20 to 40% in terms of "W+2Mo", 3.0 to 15% of V, not more than 15% of Co, and a balance of Fe and unavoidable impurities, said iron alloy having a hardness of HRC 70 or more after quenching and tempering heat treatment.

4. A rotary type compressor according to claim 3, wherein said vane is subjected to a surface treatment of at least one selected from a group consisting of nitriding, oxynitriding, sulphonitriding and homo-treatment.

* * * * *